United States Patent [19]

Gugel et al.

[11] Patent Number: 5,009,529

[45] Date of Patent: Apr. 23, 1991

[54] MATRIX PRINT HEAD OF HINGED-CLAPPER-ARMATURE CONSTRUCTION

[75] Inventors: Bernd Gugel, Ulm-Einsingen; Clemens Kaufmann, Ulm; Herbert Kitzberger, Oberstotzingen; Kurt Röhrer, Niederstotzingen, all of Fed. Rep. of Germany

[73] Assignee: Mannesmann Aktiengesellschaft, Düsseldorf, Fed. Rep. of Germany

[21] Appl. No.: 443,754

[22] Filed: Nov. 30, 1989

[30] Foreign Application Priority Data

Dec. 1, 1988 [EP] European Pat. Off. ..... 88730266.9

[51] Int. Cl.[5] ..... B41J 2/235

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,273,452 | 6/1981 | Honma | 400/124 |
| 4,537,520 | 8/1985 | Ochiai et al. | 400/124 |
| 4,594,010 | 6/1986 | Jachno | 400/124 |
| 4,626,115 | 12/1986 | Norigoe | 400/124 |

FOREIGN PATENT DOCUMENTS

| | | |
|---|---|---|
| 0110662 | 11/1983 | European Pat. Off. . |
| 0141522 | 9/1984 | European Pat. Off. . |
| 0155816 | 9/1985 | European Pat. Off. . |
| 3412855 | 10/1985 | Fed. Rep. of Germany . |

*Primary Examiner*—Edgar S. Burr
*Assistant Examiner*—C. A. Bennett
*Attorney, Agent, or Firm*—Horst M. Kasper

[57] ABSTRACT

A matrix pin print head of the hinged clapper armature construction includes several pin systems which, in each case, include a magnetic yoke limb pair (2), an electromagnetic coil (3), a hinged clapper armature (4), and a print pin (1). The multiple pin system further includes an electromagnetic coil support (13), which is produced by way of sintering or precision-casting, and which forms a single-piece component together with a base plate and the magnet yoke limb pairs (2). In a system with a low number of pins such as nine pins, the electromagnetic coil support (13) exhibits radially outwardly individual magnet yoke limbs (2*a*) and an armature guide, wherein the individual hinged clapper armatures (4) are precisely positioned and without cause for a loss of magnetic energy. In each case, the magnetic yoke limbs are directed toward a pin engagement point (8) or, respectively, to a pin attachment position (8*b*). The radial inner magnet yokes are formed to a closed, circular, or polygonal ring (17). Guide means (18), coordinated in each case to a course of pivot motions of the hinged clapper armatures (4), are coordinated to the hinged clapper armatures (4), where the guide means (18) cooperate with the receiving means (19) at the closed ring (17).

21 Claims, 2 Drawing Sheets

MATRIX PRINT HEAD OF HINGED-CLAPPER-ARMATURE CONSTRUCTION

BACKGROUND OF THE INVENTION

1. Field of the Invention

The invention relates to a matrix print head of hinged-clapper-armature construction with several pin systems, which comprise in each case a magnet yoke limb pair, an electromagnetic coil, a hinged clapper armature, and a print pin, and which includes further an electromagnetic coil support, which is produced of a sintered material or by precision casting and which forms a single-piece component together with the base plate and the magnet yoke limb pairs.

2. Brief Description of the Background of the Invention Including Prior Art

Such a matrix pin print head is known, for example, from the German Patent Application DE-A1-3,412,855 or from the U.S. Pat. No. 4,230,038. These conventional constructions exhibit U-shaped magnet yoke arm pairs. In this case, the yoke arms are of a rectangular cross-section. However, such a construction requires too large a space and surface area. The problem of position and mold errors occurs during the production. In case of sintered parts or, respectively, of precision casted parts, filling deficiencies occur in the production tool. Such filling deficiencies result in nonuniformities of the magnetic flux. The magnetic flux depends, among others, on the density of the material employed. In addition, calibration problems of the workpiece are generated. All difficulties are even further increased when the number of the pin systems employed is increased. Thus, in case of 18-pin or 24-pin systems and systems with even more pins, where the nominal diameter remains the same, it is possible only with great difficulty to coordinate the armatures relative to their angle side to the respective magnet yoke limbs or, respectively, to guide the armatures.

SUMMARY OF THE INVENTION

1. Purposes of the Invention

It is an object of the invention to construct a hinged clapper armature guide system, where the individual hinged clapper armatures are precisely positioned.

It is a further object of the present invention to provide a hinged clapper armature guide system for low number pin systems without losses of magnetic energy.

It is another object of the present invention to provide a precise positioning of the magnetic elements relative to the guiding components of the pin print head.

These and other objects and advantages of the present invention will become evident from the description which follows.

2. Brief Description of the Invention

The present invention provides for a matrix pin print head of the hinged clapper armature construction with several pin systems and including an electromagnetic coil and a hinged clapper armature. A magnetic yoke limb pair is provided for each pin system including an individual outer magnetic yoke limb. A print pin has at an end a pin connection point. An electromagnetic coil support forms a single-piece component together with a base and the magnetic yoke limb pairs. The outer individual magnet yoke limb is disposed radially outwardly relative to the electromagnetic coil support. In each case, the magnet yoke limb pairs are directed toward the pin connection point. Each radially inner magnet yoke limb is formed to be part of a circumferentially closed ring. Guide means are coordinated to the hinged clapper armatures. Said guide means, in each case, are adapted to the pivoting motion of the hinged clapper armatures. Receiving means are disposed at the closed ring. The guide means cooperate with receiving means at the closed ring.

The electromagnetic coil support can be a sintered body or a precision cast body. The pin connection point can be a pin engagement point or a pin attachment position. The circumferentially closed ring can be a circular ring or a polygonal ring. The receiving means can be provided by recesses disposed at the circumferentially closed radially inner ring. In each case the guide means for the hinged clapper armature can engage into the recesses. The guide means can be furnished by specific-shaped protrusions protruding into the recesses of the radially inner ring. Said protrusions can have a shape closely matching the shape of the recesses. The protrusions can protrude with a first delimiting side and a second delimiting side into pair-wise disposed notches of hinged clapper armatures, said armatures neighboring each other. Said protrusions can engage with one section, extending in each case to beyond the hinged clapper armature, into the recesses of the radially inner ring.

According to the invention, the electromagnetic coil support includes radially on the outside individual magnet yoke limbs which are, in each case, directed toward a pin engagement point or, respectively, toward a pin attachment position. The radial inner magnet yokes are formed to a closed, circular, and polygonal ring. The hinged clapper armatures are provided with guide means, where the guide means are coordinated in each case to the pivoting motions of the hinged clapper armatures and cooperate with receiving means at the closed ring. The magnetic flux is guided precisely and optimally through the circumferentially closed radial inner ring. The hinged clapper armatures are precision-positioned by the very accurately produceable radial inner ring. This is achieved because the receiving means can be positioned with great precision at the closed inner ring.

The precise production of this circumferentially closed radial inner ring can in addition be employed for an accurate positioning of the receiving means in that the circumferentially closed radial inner, circular, or polygonal ring exhibits recesses furnishing receiving means, where in each case guide means for the hinged clapper armatures engage into the recesses.

The accurate positioning of the hinged clapper armature, while maintaining economically produceable tolerances, can be further improved by providing protrusions protruding into the recesses of the circumferentially closed radial inner ring. These protrusions have a shape closely matching the recesses and protrude with one delimiting side in pairwise notches or indentations of neighboring hinged clapper armatures. The protrusions engage with a section reaching in each case beyond and above the hinged clapper armatures into the recesses of the circumferentially closed radial inner ring.

A further step for optimizing the magnetic flux includes that the width of the closed, circular or polygonal ring is adapted to the required magnetic flux.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
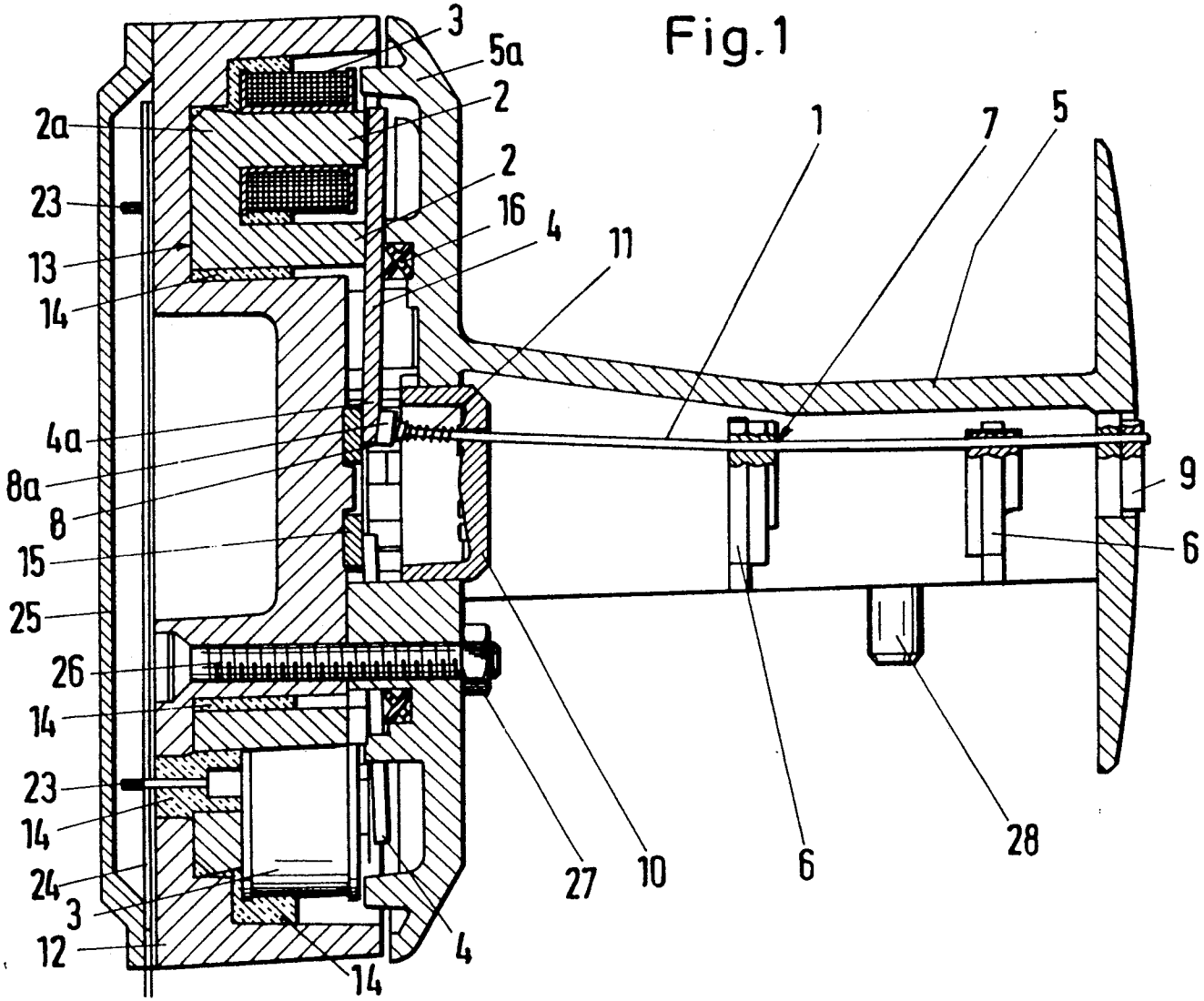
FIG. 1 shows an axial cross-section through a longitudinal axis of a matrix pin print head.

In accordance with the present invention, there is provided a matrix pin print head of the hinged clapper armature construction with several pin systems. Said systems are in each case provided with a magnetic yoke limb pair 2, an electromagnetic coil 3, a hinged clapper armature 4, and a print pin 1. An electromagnetic coil support 13 is made by sintering or by precision casting. Said coil support forms together with a base and the magnetic yoke limb pairs 2 a single-piece component. The electromagnetic coil support 13 exhibits radially outwardly individual magnet yoke limbs 2*a* which, in each case, are directed toward a pin engagement point 8 or, respectively, a pin attachment position 8*b*. The radially inner magnet yokes are formed to a closed, circular, or polygonal ring 17. Guide means are coordinated to the hinged clapper armatures 4. Said guide means 18, in each case, are adapted to the pivoting motion of the hinged clapper armatures 4. Said guide means 18 cooperate with receiving means 19 at the closed ring 17.

The radially inner, circumferentially closed, circular, or polygonal ring 17 can exhibit recesses 20 providing receiving means 19. In each case guide means 18 for the hinged clapper armature 4 can engage into the recesses 20.

Specific-shaped protrusions 21 can protrude into the recesses 20 of the radially inner, closed ring 17. Said protrusions 21 can have a shape closely matching the shape of the recesses 20. The protrusions 21 can protrude with a first delimiting side 21*a* and a second delimiting side 21*b* into pair-wise disposed notches 4*b*, 4*c* of hinged clapper armatures 4 neighboring each other. Said protrusions 21 can engage with one section 21*c*, extending in each case beyond the hinged clapper armature 4, into the recesses 20 of the radially inner, closed ring 17.

The width 17*a* of the closed, circular, or polygonal ring 17 can be adapted to the magnetic flux required.

The matrix pin print head of the hinged clapper armature construction, illustrated in FIG. 1, can exhibit for example nine, twelve, eighteen, or twenty-four print pins 1. Each print pin 1 is coordinated to a magnetic yoke limb pair 2, to an electromagnetic coil 3, and to a hinged clapper armature 4, wherein the electromagnetic coil 3 is positioned by plugging onto a radial outer magnetic yoke limb 2*a*. Nine such pin systems are illustrated in the drawing.

The print pins 1 are guided in a print pin guide casing 5 by way of individual guide walls 6. The bores 7 of the individual guide walls 6 define the arcuate course from a pin engagement point 8 of a pin print head 8*a* and the hinged clapper armature 4 up to a mouth piece 9. The mouth piece 9 is positioned opposite relative to a print counter support, not illustrated, and relative to the recording material resting at the print counter support with a pin end distance corresponding to a pin stroke. The pin engagement point 8 can also comprise a pin attachment location 8*b*. The hinged clapper armature 4 is welded to the print pin 1 at the pin attachment location 8*b*. All nine print pins 1 are guided one upon the other in the mouth piece 9 to a vertically positioned pin slot and are supported by the slot.

The print pin guide casing 5 forms a shell 5*a* in the region of the hinged clapper armature 4, where the shell 5*a* corresponds to the outer diameter or nominal diameter of the matrix pin print head. The shell 5*a* is furnished with specific elements or features for performing particular functions. Thus, a guide bush 10 is disposed in the center of the shell 5*a*, which guide bush 10 forms a counter support for a print spring 11, which print spring 11 is coordinated to each print pin 1. Further features and functions of the shell 5*a* will be described below.

A rear casing 12 receiving the systems can be made of a plastic or aluminum or other magnetically non-conducting materials. The rear casing 12 centers a single-piece electromagnetic coil support 13 made of sintered material or as a precision casting. The single-piece electromagnetic coil support 13, made with high precision and with a high surface quality, is disposed within the rear casing 12 and is insulated magnetically by an electrically non-conducting filler mass 14. The rear casing 12, made of aluminum, is further furnished with a centered and attached, heat-resistant damping disk 15, where the radial inner armature limbs 4*a* rest on the damping disk 15 in a base or rest position.

The hinged clapper armatures 4 are fixed with the radial inner armature limbs 4*a* by way of this damping disk 15 and are pivotally supported about in the center by an elastic damping ring 16 having an about quadrangular cross-section as well as by the oppositely disposed radial inner magnet yoke limb of the magnetic yoke limb pair 2.

The single-piece electromagnetic coil support 13 forms the individual magnet yoke limbs 2*a* at a radially outward position. The coordinated radial inner magnet yoke limbs form a closed ring 17, which is of circular or polygonal shape and which is formed in conformance to the number of the pin systems employed.

The hinged clapper armatures 4 perform pivoting motions in order to convey a stroke motion to the print pins 1. Such stroke motions, where the forward and the rearward stroke amount each to about 0.3 mm, are performed at a frequency of from about 2000 to 3000 Hz. In order to perform without problem the hinged clapper armature tilting motions from an oscillation-technical point of view, guide means 18 are necessary.

Figure 2:
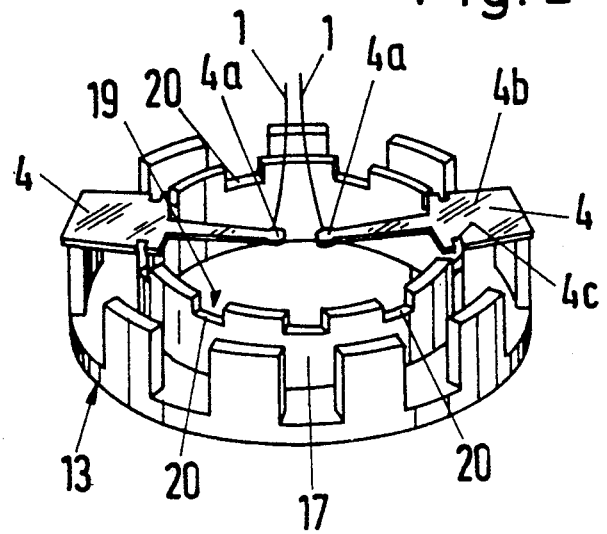
FIG. 2 shows a perspective view of a single-piece electromagnetic coil support illustrating two individual hinged clapper armatures and print pins.

The guide means 18 cooperate with the receiving means 19, illustrated in FIG. 2, at the closed ring 17.

Figure 3:
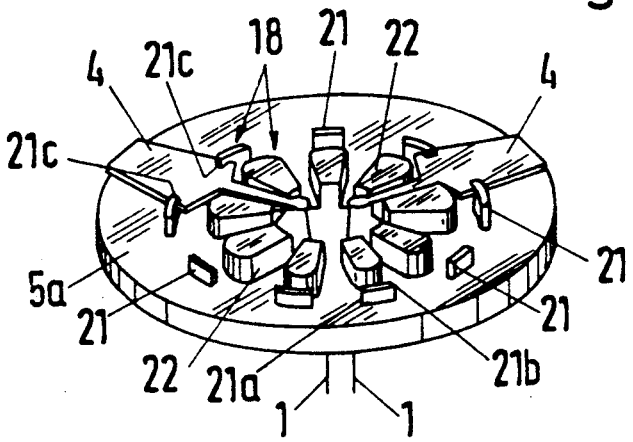
FIG. 3 shows a schematic perspective view of the part of a pin guide casing in an assembled state, which casing is disposed opposite to the electromagnetic coil support illustrated in FIG. 2.
Figure 4:
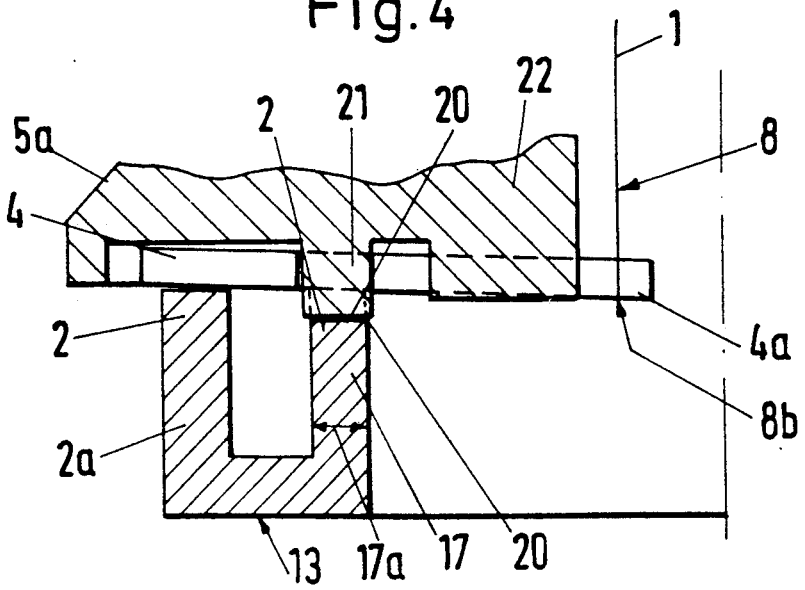
FIG. 4 shows a partial cross-section through a longitudinal axis with a single-piece electromagnetic coil support, hinged clapper armature, and a pin guide casing.

According to the specific embodiment of FIGS. 2 to 4, the receiving means 19 include recesses 20, where protrusions 21, shaped corresponding to the recesses 20, form a guide means 18 and protrude into the recesses 20. The protrusions 21 exhibit a first delimiting side 21*a* and a second delimiting side 21*b*. One of the two delimiting sides 21*a* or, respectively, 21*b* protrudes into pairwise present insertions 4*b*, 4*c* of the hinged clapper armature 4. The protrusions 21, however, protrude also in these notches 4*b*, 4*c* over the hinged clapper armature 4 with sections 21*c*. The protrusions 21 grip and engage with these sections 21*c* into the recesses 20 of the radially inward disposed closed ring 17. The protrusions 21 center also the hinged clapper armature 4, and thus form guide means 18 constructed corresponding to the pivoting motions of the hinged clapper armatures 4, where the guide means 18 cooperate with the receiving means 19 at the closed ring 17.

The hinged clapper armatures 4 are additionally guided in the region of the radial inner armature limb 4*a*, in each case, by cams 22. The shell 5*a* is placed onto the ring 17 in FIG. 2 in a reversed position relative to the position illustrated in FIG. 3 into the operating position illustrated in FIG. 4, where the position illustrated in FIG. 3 is provided for a better and easier recognition of the representation. The direction of the course of the print pins 1 in FIGS. 2 and 3 serves in this placement process for orientation purposes.

Connection lines 23 are led from the electromagnetic coils 3 through the filler mass 14 and are guided to a circuit board 24. The circuit board 24 is protected by a cover 25. The print pin guide casing 5 or, respectively, the shell 5*a* and the rear casing 12 are maintained in position by several bolts 26 engaging nuts 27.

The width 17*a* of the ring 17, illustrated in FIG. 4, serves as an adjustment possibility for optimizing the magnetic flux in order to work with a most favorable magnetic saturation.

The matrix pin print head, illustrated in FIG. 1, is placed in a position by way of a pair of alignment pins 28 onto a print head carriage.

The recesses can have a depth of from about 0.1 to 0.5, and preferably from about 0.2 to 0.25, times the length of the radially inner ring in axial direction. The guide means can have a total length in axial direction of from about 0.2 to 0.8, and preferably from about 0.4 to 0.5, times the length of the radially inner ring in axial direction. The guide means can have a width in radial direction of from about 0.8 to 1.5, and preferably from about 1.0 to 1.2, times the width of the radially inner ring in radial direction. The width of the circumferentially closed ring can be adapted to the magnetic flux required.

The width of the recesses 20 can be from about 0.5 to 1 times the width of the ring 17 formed by magnetic yoke limbs. The depth of the recess 20 can be from about 0.2 to 0.6 times the height of the protrusion 21 and is preferably from about 0.3 to 0.5 times the height of the protrusion 21. The protrusions 21 can be disposed on the flat shell 5*a*. The height of the protrusion 21 can be from about 0.2 to 0.5 times the length in axial direction of the ring 17 and is preferably from about 0.3 to 0.4 times the length of the ring 17 in axial direction.

It will be understood that each of the elements described above, or two or more together, may also find a useful application in other types of matrix print heads differing from the types described above.

While the invention has been illustrated and described as embodied in the context of a matrix pin print head of the hinged clapper armature construction with several systems, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A matrix pin print head of the hinged clapper armature construction with several pin systems comprising a magnetic yoke limb pair for each pin system including an individual outer magnetic yoke limb;

an electromagnetic coil;

a hinged clapper armature having opposed notches;

a print pin having at an end a pin connection point;

a circumferentially closed ring;

an electromagnetic coil support forming with the magnetic yoke limb pairs a single circular piece component and wherein the outer individual magnet yoke limb and wherein, in each case, the magnet yoke limb pairs are disposed on a radial line passing through the pin connection point, and wherein each radially inner magnet yoke limb is formed to be part of the circumferentially closed ring;

a shell;

guide means attached to and projecting from the shell and receiving means disposed in the closed ring, said opposed notches being aligned with said receiving means, said guide means being received in said opposed notches and said receiving means to confine the pivoting motion of the hinged clapper armatures.

2. The matrix pin print head according to claim 1, wherein the electromagnetic coil support is a sintered body.

3. The matrix pin print head according to claim 1, wherein the electromagnetic coil support is a precision cast body.

4. The matrix pin print head according to claim 1, wherein the pin connection point is a pin engagement point.

5. The matrix pin print head according to claim 1, wherein the pin connection point is a pin attachment position.

6. The matrix pin print head according to claim 1, wherein the circumferentially closed ring is a circular ring.

7. The matrix pin print head according to claim 1, wherein the circumferentially closed ring is a polygonal ring, wherein an axial symmetry of the polygonal ring corresponds to an axial symmetry generated by the pin.

8. The matrix pin print head according to claim 1, wherein the receiving means are provided by recesses disposed at the circumferentially closed radially inner ring, wherein in each case the guide means for the hinged clapper armature engage into the recesses.

9. The matrix pin print head according to claim 8 further comprising notches disposed pairwise at the hinged clapper armature, wherein the guide means are furnished by protrusions protruding into the recesses of the radially inner ring, wherein the protrusions have a shape closely matching the shape of the recesses and wherein the protrusions protrude with a first delimiting side and a second delimiting side into pair-wise disposed notches of hinged clapper armatures, said armatures neighboring each other, and which protrusions with one section of the each protrusion, extending in each case to beyond the hinged clapper armature engage into the recesses of the radially inner ring.

10. The matrix pin print head according to claim 8, wherein the recesses have a depth of from 0.1 to 0.5 times the length of the radially inner ring in axial direction.

11. The matrix pin print head according to claim 8, wherein the recesses have a depth of from 0.2 to 0.25 times the length of the radially inner ring in axial direction.

12. The matrix pin print head according to claim 8, wherein the guide means have a total length in axial direction of from 0.2 to 0.8 times the length of the radially inner ring in axial direction.

13. The matrix pin print head according to claim 8, wherein the guide means have a total length in axial direction of from 0.4 to 0.5 times the length of the radially inner ring in axial direction.

14. The matrix pin print head according to claim 8, wherein the guide means have a width in radial direction of from 0.8 to 1.5 times the width of the radially inner ring in radial direction.

15. The matrix pin print head according to claim 8, wherein the guide means have a width in radial direction of from 1.0 to 1.2 times the width of the radially inner ring in radial direction.

16. The matrix pin print head according to claim 1, wherein the width of the circumferentially closed ring is furnished based on the magnetic flux required.

17. A matrix pin print head of the hinged clapper armature construction with several pin systems, which comprises in each case a magnetic yoke limb pair (2), an electromagnetic coil (3), a hinged clapper armature (4) having opposed notches, and a print pin (1), a circumferentially closed ring, and further including an electromagnetic coil support (13), said electromagnetic coil support made by molding and heating, and said coil support forming with the magnetic yoke limb pairs (2) a single circular piece component, said electromagnetic coil support (13) exhibiting radially outwardly individual magnet yoke limbs (2*a*), each said individual magnet yoke disposed on a radial line passing through a pin contacting position (8*b*), and wherein the radially inner magnet yokes are formed to a closed, circular or polygonal ring (17), wherein an axial symmetry of the polygonal ring corresponds to an axial symmetry generated by the print pin (1), and wherein guide means are attached to and projecting from a shell, and receiving means (19) are disposed in the closed ring (17), said opposed notches being aligned with said receiving means (18), said guide means (19) being received in said opposed notches and said receiving means (18) to confine the motion of the hinged clapper armature (4).

18. The matrix pin print head according to claim 17, wherein the radially inner, circumferentially closed, circular to polygonal ring (17) exhibits recesses (20) providing receiving means (19), where in each case guide means (18) for the hinged clapper armature (4) engage into the recesses (20).

19. The matrix pin print head according to claim 18, wherein specific-shaped protrusions (21) protrude into the recesses (20) of the radially inner, closed ring (17), wherein the protrusions (21) have a shape closely matching the shape of the recesses (20) and wherein the protrusions (21) protrude with a first delimiting side (21*a*) and a second delimiting side (21*b*) into pair-wise disposed notches (4*b*, 4*c*) of hinged clapper armatures (4) neighboring each other and which protrusions (21) engage with one section (21*c*), extending in each case beyond the hinged clapper armature (4), into the recesses (20) of the radially inner, closed ring (17).

20. The matrix pin print head according to claim 17, wherein the width (17*a*) of the closed, circular to polygonal ring (17) is structured based on the magnetic flux required.

21. A matrix pin print head of the hinged clapper armature construction with several pin systems comprising a magnetic yoke limb pair for each pin system including an individual outer magnetic yoke limb;

an electromagnetic coil;

a hinged clapper armature having opposed notches;

a print pin having at an end a pin connection point;

a circumferentially closed ring;

an electromagnetic coil support forming with the magnetic yoke limb pairs a single axially symmetrical polygonal piece component and wherein the outer individual magnet yoke limb and wherein, in each case, the magnet yoke limb pairs are disposed on a radial line passing through the pin connection point, and wherein each radially inner magnet yoke limb is formed to be part of the circumferentially closed ring;

a shell;

guide means attached to and projecting from the shell and receiving means disposed in the closed ring, said opposed notches being aligned with said receiving means, said guide means being received in said opposed notches and said receiving means to confine the pivoting motion of the hinged clapper armatures.

* * * * *